US005752837A

United States Patent [19]

Palmer

[11] Patent Number: 5,752,837

[45] Date of Patent: May 19, 1998

[54] TOOL KIT FOR FACILITATORS AND TRAINERS

[76] Inventor: Mary Margaret Palmer, 5400 Freidrich La., No. 61, Austin, Tex. 78744

[21] Appl. No.: 838,566

[22] Filed: Apr. 11, 1997

Related U.S. Application Data

[63] Continuation-in-part of Ser. No. 686,542, Jul. 26, 1996, abandoned.

[51] Int. Cl.[6] ..... B43L 1/00

[52] U.S. Cl. ..... 434/413; 434/408; 434/415; 434/429; 434/430

[58] Field of Search ..... 434/408, 430, 434/413, 415, 421, 429; 206/1.7

[56] References Cited

U.S. PATENT DOCUMENTS

| | | | |
|---|---|---|---|
| 2,867,045 | 1/1959 | Millgate . | |
| 3,345,760 | 10/1967 | Myhr . | |
| 3,497,969 | 3/1970 | Schwoegler | 434/421 X |
| 3,642,191 | 2/1972 | Roof | 434/408 X |
| 4,978,568 | 12/1990 | Postma | 434/408 X |
| 5,035,626 | 7/1991 | Persing | 434/408 |
| 5,137,453 | 8/1992 | Hudson | 434/408 |
| 5,409,383 | 4/1995 | Mannino | 434/414 |

*Primary Examiner*—Jeffrey A. Smith
*Attorney, Agent, or Firm*—Joseph F. Long

[57] ABSTRACT

A kit or cohesive group of reusable elements to aid a facilitator or trainer to enhance interchange and organization of group discussions comprising portable foldable backboards, plastic erasable, reusable recording sheets, at least one process display wallboard, multiple colored or imprinted cards of variable shapes and sizes that will allow recording thereon and removably cling to said sheets and said wallboard and necessary marking and erasing accessories. With a preferred embodiment further including a specially designed carrying cases for ease of transport of said components.

3 Claims, 6 Drawing Sheets

TOOL KIT FOR FACILITATORS AND TRAINERS

BACKGROUND

This invention is a continuation-in-part of Ser. No. 08/686,542 filed Jul. 26, 1996 entitled "A Tool Kit for Facilitators and Trainers" (now abandoned). The major differences between this and the parent patent are simpler improved carrying cases and a foldable backboard with rigidizing side strips.

There are several patents that are intended to aid the discussion leader or trainer, indicating a continuing interest in improving and expediting training. The following patents in this field have been considered:

| Patent No. | Patent Date | Inventor |
|---|---|---|
| 4,940,628 | Jul. 10, 1990 | Lin et al. |
| 5,024,332 | Jun. 18, 1991 | Stachler |
| 5,035,626 | Jul. 30, 1991 | Persing |
| 5,207,581 | May 4, 1993 | Boyd |
| 5,409,383 | Apr. 25, 1995 | Mannino |
| 5,353,535 | Oct. 4, 1994 | Su |
| 2,867,045 | Jan. 6, 1959 | Millgate |
| 4,815,767 | Mar. 28, 1989 | Lambert |
| 4,996,110 | Feb. 26, 1991 | Tanuma et al. |

Although several of these patents have some similar features to some elements of the subject invention, none have multi-element cohesive training and display aids to meet the needs of trainers and facilitators. The subject invention includes but is not limited to the following components;

- recording and display sheets that have a surface that will allow use of either wet or dry markers and have holes that will allow hanging or wall mounting;
- a foldable backboard with an erasable surface that is mountable on an easel and has holes to allow using pegboard hooks to hang multiple recording sheets;
- a multiplicity of wet and dry markers;
- at least one wall mountable process display wallboard that may be about four feet by eight feet with holes to allow wall mounting and surface and composition similar or the same as the recording sheets;
- multiple different shaped and different colored cards, called posts, with a removable paper or plastic backing. The posts have marker erasable surfaces and static retaining surfaces so that such posts will removably but firmly cling to the recording sheets or to the display board. These posts may be clear, may have various symbols or logos thereon or may be clear and colored for recording thereon. Grouping of these posts may be used for enhanced visualization of ideas and discussion points. For example the cloud shaped posts could be grouped at the direction of participants to indicate "far out" or "cloud nine" ideas.
- thin vinyl or plastic ribbons that may have various colors and that will cling to the recording and display sheets and the process display wallboard and may be of various lengths and widths with the preferred width being from one fourth to over one inch wide and may be used to create lines, grids, or segmenting a recording or display board to give visual effect to a group discussion.
- multiple foldable erasable name tents are provided to aid the trainer in personal interchange,

- accessories including the wet erasable and dry erasable markers, a water spray bottle, and cleaning cloths as part of the kit.

In this embodiment specially designed carrying cases with shoulder straps to carry all the above items would normally be included.

SUMMARY OF THE INVENTION

This invention may be summarized as a transportable kit to allow enhanced informational meetings, training meetings, discussion meetings, group think meetings etc. using an erasable, reusable, transportable system. The contents of the kit can be application specific. A preferred generalized kit to meet many uses would contain the following:

- a minimum of one foldable backboard with rigidizing side strips with the backboard being about the size of a normal easel pad with holes to allow mounting on a normal easel and with holes to allow using pegboard hooks in the backboard for hanging recording sheets;
- a minimum of fifteen erasable rehangable recording sheets with a surface to allow use of wet or dry markers;
- a minimum of ten foldable erasable name tents;
- a minimum of two each of black green, blue, and red wet erase markers;
- a minimum of two each black and blue dry erase markers;
- a minimum of one wall mountable process display wallboard usually eight to ten feet long with recordable, erasable surface;
- twelve or more each of different shaped and colored cards (normally called "posts") that will cling to the surfaces of the recording sheets, and process display wallboard with the surfaces of said cards allowing both dry and wet erasure;
- ribbons of various lengths and widths that will removably but firmly cling to the recording sheets and display wallboard;
- a water spray bottle,
- at least three cleaning cloths and
- a cylindrical cloth carrying bag with a side zipper to carry a cylindrical cardboard case approximately 28 inches tall and 10 inches in diameter that will allow transporting all the above items except the large wall mount process display wallboard. A second cylindrical cloth carrying case with an internal cardboard stiffener is used to transport one or more of the wall mount display boards.

DESCRIPTION OF THE INVENTION

The invention may best be described from the drawings.

Figure 1:
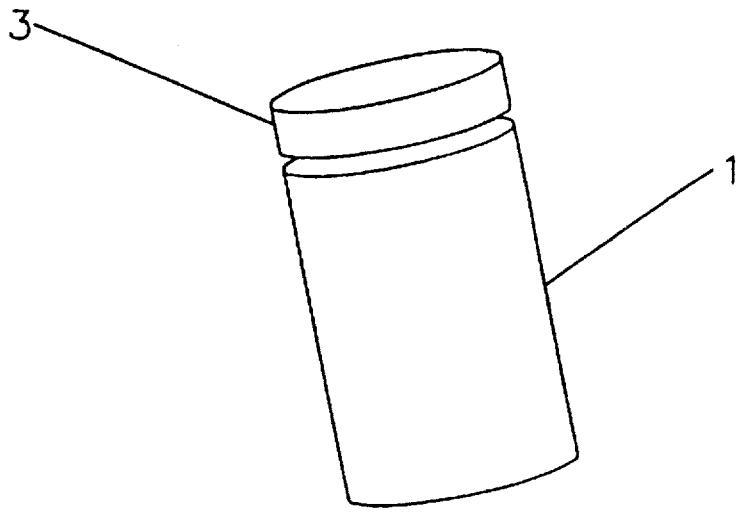
FIG. 1 shows a three dimensional view of the cardboard container to carry all elements of the tool kit except the large wall mount board.

FIG. 1 comprises a cylindrical cardboard container 1 with a plastic top 3 that may be about 10 inches in diameter and about 27 inches long to contain all the major elements of the tool kit except the process display wallboard.

Figure 2:
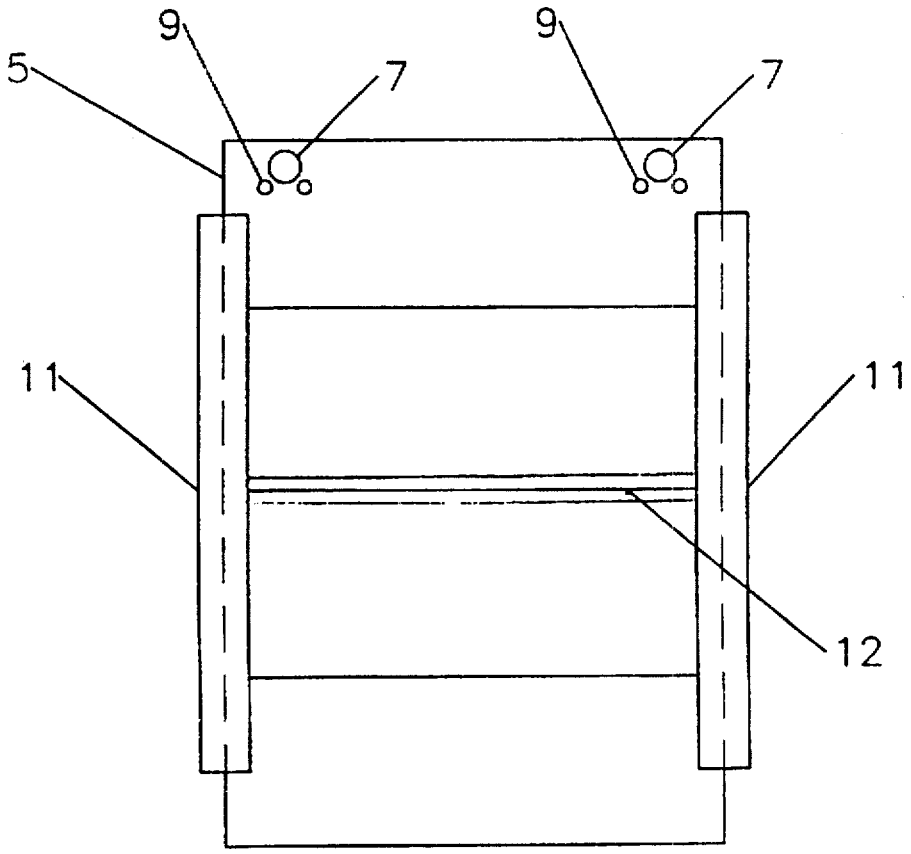
FIG. 2 shows the foldable backboard.

FIG. 2 shows the foldable backboard 5 with rigidizing strips 11 in place. As shown the backboard is composed of four segments held together with tape 12 to form hinges. The tape 12 to form the central hinge is on the front of the central segments with other segments taped together in the back to allow folding to a flat unit. For other units multipile segments could be used. The top segment has large holes 7 spaced to allow mounting on a normal easel and pairs of holes 9 to accept hooks as shown in FIG. 4 to allow hanging worksheets from the backboard.

Figure 3:
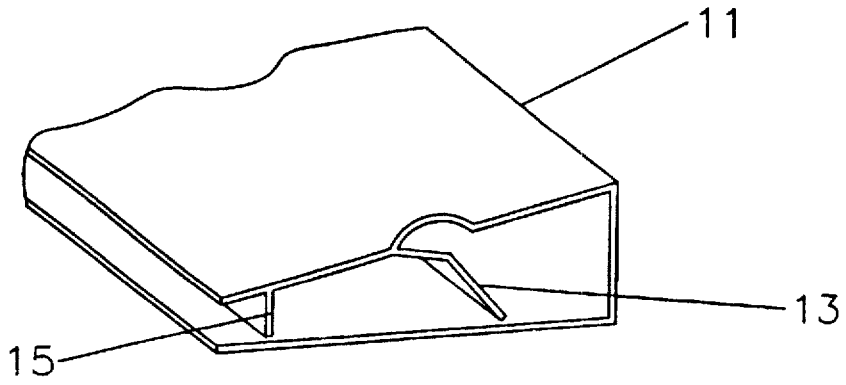
FIG. 3 shows an end view of the rigidizing strips for the backboard.

In FIG. 3 a segment of the plastic rigidizing strip 11 is shown that may be made of polyvinyl chloride. When segments of the back board 5 are slipped below protrusions 13 and 15 the back board will be held to act as a rigid board.

Figure 4:
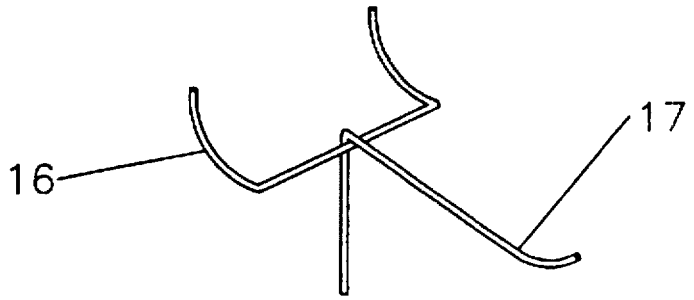
FIG. 4 shows a pegboard hook or hanger for hanging worksheets on the backboard.

FIG. 4 shows a hanging hook 17. When bent arms 16 are slipped into holes 9 in backboard 5, FIG. 2 the hooks allow hanging worksheets as shown in FIG. 7 on the backboard.

Figure 5:
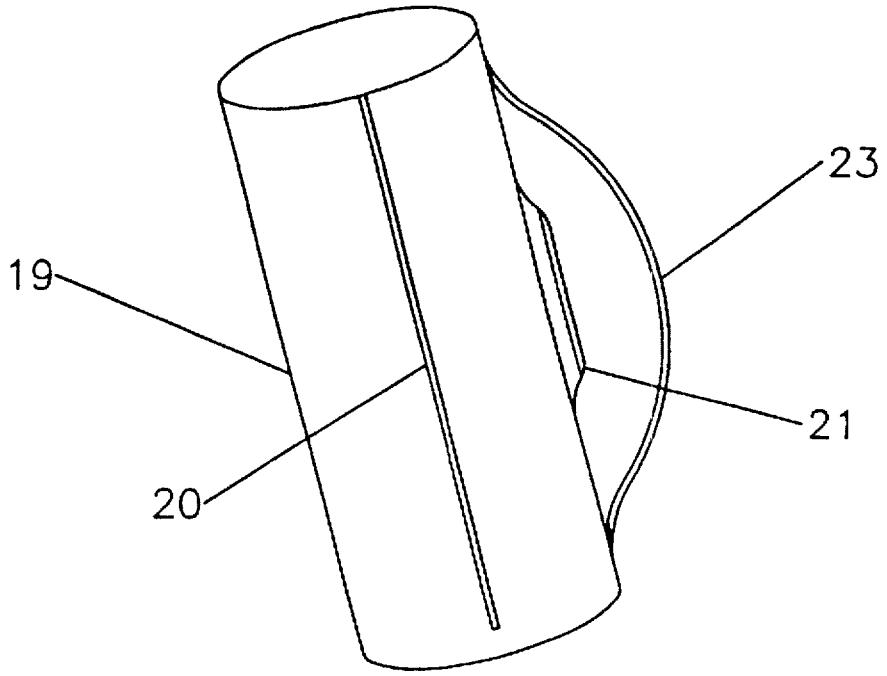
FIG. 5 shows a cloth carrying case to transport the cylindrical container for the major kit parts.

FIG. 5 shows a flexible carrying case 19 with zipper 20 and carrying straps 21 and 23. The case may be cloth, plastic or leather with nylon cloth being preferred and is sized to removably to hold container 1, FIG. 1.

Figure 6:
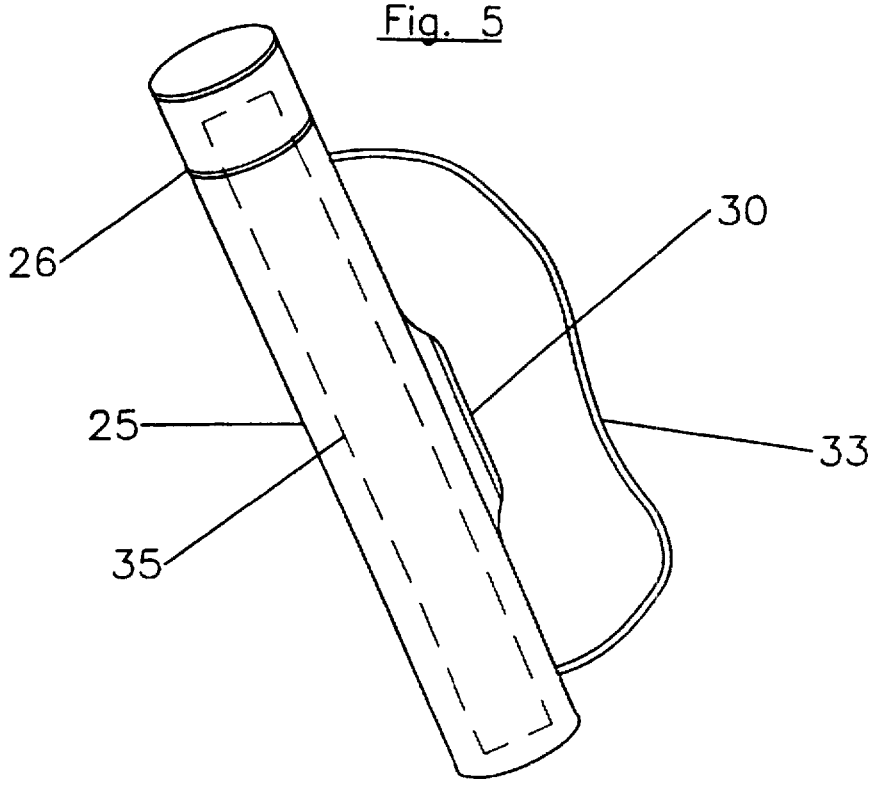
FIG. 6 shows a cloth carrying case for the wall mount wallboard.
Figure 9:
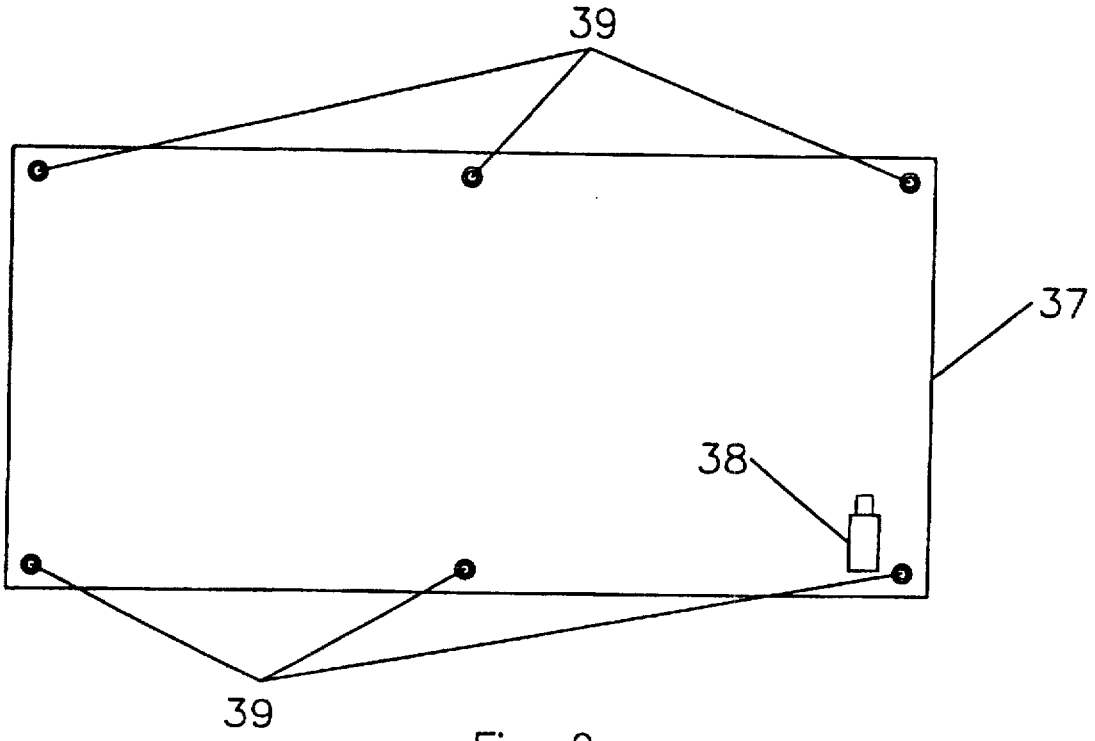
FIG. 9 shows a transportable wall mountable process display wallboard.

FIG. 6 shows a flexible carrying case 25 with zipper closure 26 and carrying straps 30 and 33 sized for transport of process display wallboard 37, FIG. 9. An internal stiffener 35 may be a mailing tube or about a b 4inch square cardboard box that is long enough to protect the ends of process display wallboard 37, FIG. 9 when the wallboard is rolled for transport.

Figure 7:
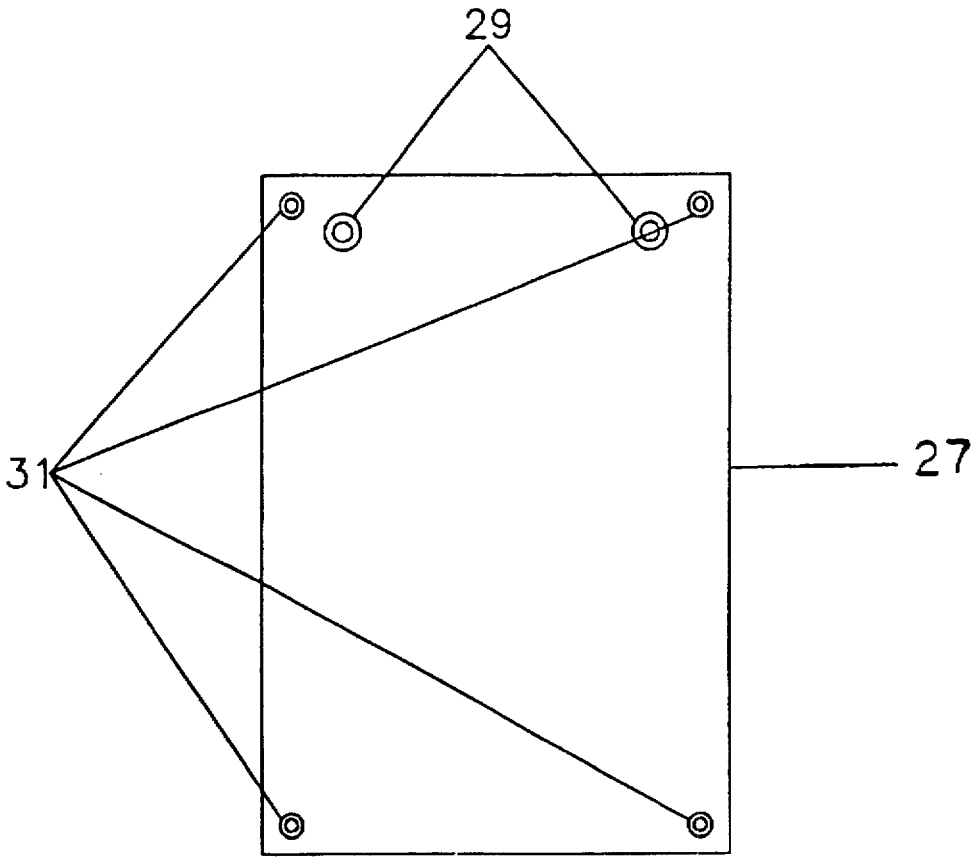
FIG. 7 shows one of multiple plastic recording or worksheets.

FIG. 7 shows process display or recording sheets 27. Each sheet has grommets or holes 31 which are about one fourth inch to use for wall mounting using thumbtacks or pins and grommets or holes 29 which are one half inch and spaced to hang on pegboard hangers in holes 9, FIG. 2. With some plastics holes alone would be sufficient for many reuses.

Figure 8:
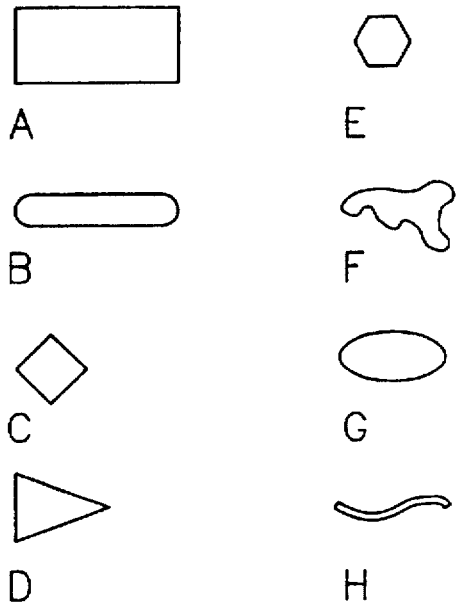
FIG. 8 shows a variety of shapes to be used for recording and particular effect in the system.

FIG. 8 shows a multiplicity of shapes that are used for erasable recording and are normally called posts. Posts may be cut from silk screened sheets of a static holding plastic such as HI-STAT® vinyl laminated to pressure sensitive "Mylar®" plastic sheet and with a stiff paper backing as sold by Catalina Plastics Coating Corporation of Las Vegas, Nev. Generally multiple posts that may be clear or silk screened with colors and/or symbols are included in the kit. In FIG. 8 sizes may be about as follows:

Rectangle A . . . 5×7 inches

Strip B . . . 2×8 inches

Diamond C . . . 5×7 inches

Triangle D . . . 4×7 inches

Hexagonal E . . . 7×6 inches

Cloud F . . . 3×8 inches

Oval G . . . 6×8 inches

Strips H . . . ¼ to ½ inch×various lengths

The strips or ribbon H shown may be of various lengths and widths with ¼ inch wide strips preferred. These strips are normally a thin vinyl plastic and are used for lining off the recording sheets and display wallboard and are shipped and handled to tear off from a backing.

A user may cut many other shapes and all shapes would be included in the invention. The laminated vinyl is peeled off the paper backing for use and clings well but removably to the recording sheets and process display wallboard. For reuse and storage the posts are preferably interleaved with the saved paper backing.

FIG. 9 shows a process display wallboard 37 having holes or grommets 39 that may be used for wall mounting with pins or hangers and having a container 38 to hold markers. the process display wallboard is similar to the recording sheets but may be a thicker plastic. A usual size would be about eight feet by four feet and this size may be rolled to fit around a rigid card board box or to fit inside a mailing tube for transport.

Figure 10:
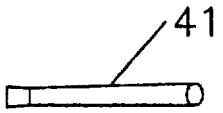
FIG. 10 shows a marker of a preferred type.

FIG. 10 shows a marker 41 that may form a mark that is erasable with wet or dry cloth. Both wet and dry markers are used and included in the kit of this invention.

Figure 11:
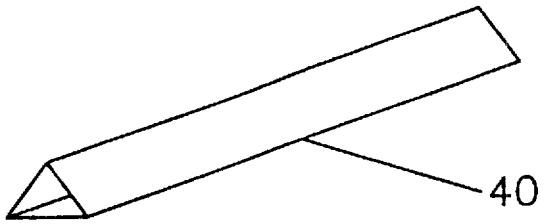
FIG. 11 shows a foldable reusable name tent with a marker erasable surface.

FIG. 11 shows a foldable name tent 40 that may be made from a semi-rigid vinyl plastic with imprinted grooves to facilitate folding. VELCRO® type cloth fasteners, not shown, may be used to firmly hold the tent in an in-use position while allowing unfolding for transport.

What is claimed is:

1. A tool kit for discussion leaders comprising:

a) a minimum of one foldable backboard having rigidizing side members and having holes to allow connecting with a top member of an easel; said foldable backboard having a surface that allows erasable marking and having holes therein to allow insertion of pegboard hangers at a distance to allow use of a normal chart pad;

b) multiple plastic recording sheets; said sheets each having holes for hanging on said pegboard hangers and to allow wall mounting with pins and said sheets having surfaces to allow wet and dry marking;

c) a minimum of one wall mountable process display wallboard with surfaces to allow wet and dry marking with a holder for multiple markers mounted to said display wallboard and with said display wallboard having sufficient flexibility to be rolled for transport;

d) multiple colored recording cards in each of several shapes selected from a group consisting of squares, rectangles, ovals, triangles, hexagonals, and diamond shapes and each having a static holding side to allow each to removably but firmly cling to said plastic recording sheets and said process display wallboard; and e) a multiplicity of colored static holding plastic ribbons, each of which will removably but firmly cling to said plastic recording sheets.

2. A tool kit for discussion leaders as in claim 1 further comprising:

a) a first cylindrical container and removable closure to close an open end of said container; said container being sized to hold all components of said tool kit except said process display wallboard;

b) a first carrying case means with a zippered closure to contain said first cylindrical container; and c) a second carrying case means with a zippered closure to carry a minimum of one of said process display wallboards.

3. A tool kit for discussion leaders comprising:

a) a minimum of one foldable backboard with removable slide on side strips to hold said backboard in a rigid position; said backboard having holes to allow connecting with a top member of an easel; and said backboard having a surface to allow erasable marking and having holes therein to allow insertion of pegboard hangers at a distance to allow use of a normal chart pad;

b) multiple plastic recording sheets; said sheets having holes for hanging on said pegboard hangers and holes to allow wall mounting with pins and said sheets having surfaces to allow wet and dry marking;

c) a minimum of one wall mountable process display wallboard with surfaces to allow wet and dry marking and having sufficient flexibility to be rolled for packaging in a mailing tube;

d) multiple colored recording cards in each of several shapes and each having a static holding side to allow each to removably but firmly cling to said plastic recording sheets and said process display wallboard;

e) a multiplicity of colored static holding plastic ribbons, each of which will removably but firmly cling to said plastic recording sheets; and f) multiple colored markers.

* * * * *